US008800154B2

(12) United States Patent
Schmidt

(10) Patent No.: US 8,800,154 B2
(45) Date of Patent: Aug. 12, 2014

(54) TELESCOPIC SIGHT ALIGNMENT TOOL

(76) Inventor: Gerald Lee Schmidt, Bozeman, MT (US)

( * ) Notice: Subject to any disclaimer, the term of this patent is extended or adjusted under 35 U.S.C. 154(b) by 210 days.

(21) Appl. No.: 13/491,433

(22) Filed: Jun. 7, 2012

(65) Prior Publication Data

US 2013/0326893 A1 Dec. 12, 2013

(51) Int. Cl.

| | |
|---|---|
| ***G01C 15/00*** | (2006.01) |
| *A47B 27/00* | (2006.01) |
| *B43L 5/00* | (2006.01) |
| *B43L 13/00* | (2006.01) |
| *B43L 13/24* | (2006.01) |
| *B43L 13/02* | (2006.01) |
| *G01C 3/04* | (2006.01) |
| *G01C 3/10* | (2006.01) |

(52) U.S. Cl.

USPC ..... 33/286; 33/245; 33/247; 33/248; 33/292

(58) Field of Classification Search

USPC ..... 33/245, 248, 286, 292, 247; 42/120, 42/129

See application file for complete search history.

(56) References Cited

U.S. PATENT DOCUMENTS

| | | | | |
|---|---|---|---|---|
| 2,876,546 | A | 2/1959 | Vissing | |
| 5,442,860 | A | 8/1995 | Palmer | |
| 5,769,280 | A * | 6/1998 | Ehresmann | 222/185.1 |
| 5,878,504 | A * | 3/1999 | Harms | 42/120 |
| 6,813,855 | B2 | 11/2004 | Pinkley | |
| 6,862,833 | B1 * | 3/2005 | Gurtner | 42/120 |
| 2007/0113460 | A1 | 5/2007 | Potterfield et al. | |
| 2008/0104875 | A1 * | 5/2008 | Mayerle | 42/118 |

* cited by examiner

*Primary Examiner* — Peter Macchiarolo
*Assistant Examiner* — Rhyan C Lange
(74) *Attorney, Agent, or Firm* — Richard C Litman

(57) ABSTRACT

The telescopic sight alignment tool is used to align the horizontal and vertical axes of the scope with corresponding axes of the firearm upon which the scope is mounted. The tool comprises a unitary structure having a plate with a vertical crosshair alignment slit, with an ocular seat extending forward from the lower portion of the plate. Upper and lower alignment indicators extend from the plate. Alternative embodiments provide variations upon the alignment indicators. The tool is placed upon the ocular of the scope and secured adjustably thereon with an elastic band. The tool is rotated to align the slit precisely with the vertical crosshair of the scope. The scope is then rotated in its mounts until at least one of the indicators of the tool is aligned with an element of the firearm, e.g., front sight, tang of the action, etc., and the mounts tightened to secure the scope.

8 Claims, 8 Drawing Sheets

TELESCOPIC SIGHT ALIGNMENT TOOL

BACKGROUND OF THE INVENTION

1. Field of the Invention

The present invention relates to telescopic sights for firearms, and particularly to a tool or gauge for aligning a telescopic sight with an associated firearm so the telescopic sight and reticle therein is square with the horizontal lateral and vertical axes of the firearm.

2. Description of the Related Art

The telescopic sight for rifles and other firearms has proven to be of great assistance in the quest by marksmen for greater accuracy. Indeed, many of the various factors that are considered by expert shooters can only be compensated for by an accurately aligned telescopic sight or "scope" on the firearm. It should also be noted that while telescopic sights were first developed for rifles firing a single round over a relatively long distance, telescopic sights or scopes have been installed on handguns and shotguns as well, and the need exists for accurate alignment of the scope with these types of firearms as well.

There are various aspects of scope alignment that must be considered. Obviously, the optical axis of the scope must be aligned with the barrel of the firearm. This type of alignment is handled by different tools and gauges than the telescopic sight alignment tool of the present invention, and the tool of the present invention does not measure or determine the alignment of the optical axis of the scope with the barrel of the firearm. However, another consideration is the parallelism between the horizontal and vertical crosshairs of the reticle of the scope, and the corresponding horizontal lateral and vertical axes of the firearm. It will be seen that if the vertical axis of the scope is not aligned with or at least parallel to the vertical axis of the firearm upon which the scope is installed, the vertical axis of the firearm will not be truly vertical when the crosshairs of the scope reticle are truly vertical and horizontal. As virtually all scopes are adjustable for elevation (bullet drop) for the distance between the firearm and the target, it will be seen that any angularity between the scope and the firearm will tend to cant the plane of the elevation adjustment from the vertical, leading to unintended lateral displacement of the round when it hits the target. U.S. Pat. No. 6,862,833 issued on Mar. 8, 2005 to Frederick W. Gurtner provides a good explanation of this phenomenon, as well as a tool for measuring and correcting for non-parallelism between the vertical and horizontal axes of the scope and firearm.

Numerous other devices have been developed to measure and accommodate any lack of parallel between the horizontal and vertical axes of the scope and firearm. An example of such is found in German Patent Publication No. 3,401,855 published on Jul. 25, 1985 to Walther GMBH. This device comprises a sight ring that is installed about the ocular of the scope. The ring is partially filled with a colored liquid and acts somewhat as a bubble level in allowing the marksman to align the axes of the scope, and thus the attached firearm, in accordance with the sight ring.

None of the above inventions and patents, taken either singly or in combination, is seen to describe the instant invention as claimed. Thus, a telescopic sight alignment tool solving the aforementioned problems is desired.

SUMMARY OF THE INVENTION

The telescopic sight alignment tool comprises various embodiments, each comprising a unitary block of material adapted for adjustable placement on the ocular or eyepiece of a telescopic sight. Each of the embodiments includes a plate that abuts the ocular of the scope and that defines a plane normal to the optical axis of the scope when the tool is installed on the ocular of the scope. The plate includes a very narrow slit therethrough that is aligned with the vertical crosshair of the scope reticle. An ocular seat having the general form of a V notch with a rounded apex extends forward, i.e., toward the muzzle of the firearm, from the lower portion or end of the plate, with the ocular of the scope seating in this V notch. A shallow groove extends about the outer surface of the structure defining the V notch, to hold an elastic band (rubber band, etc.) about the tool and about the ocular of the scope. This structure permits the tool to be rotated about the optical axis of the scope to allow the slit in the plate to be aligned precisely with the vertical crosshair of the scope reticle.

The various embodiments of the telescopic sight alignment tool differ in the arrangement of the external indicators provided for alignment with the firearm and/or with a straightedge used with the firearm. In one embodiment, upper and lower pointers or indicators are aligned vertically with the slit, with the scope then being rotated about its optical axis in its mounts to align either or both of the pointers with some structure of the firearm barrel or action (e.g., the forward sight, the tang of the action or groove therein, etc.). The scope mounts are then tightened to secure the scope with its horizontal lateral and vertical axes aligned parallel to those of the firearm. A subset of the above described embodiment provides for the lower indicator to continue forward of the groove for the elastic band, i.e., for the full length of the ocular seat. In another embodiment the lower outboard corners of the device are removed to provide scallops or reliefs therein. This configuration provides additional lateral reference points for aligning the device and scope relative to a horizontal reference placed across the firearm, particularly when used with telescopic sights having relatively large oculars or eyepieces.

The present telescopic sight alignment tool provides for alignment of the horizontal and vertical axes of the scope with the corresponding axes of the firearm without reference beyond the firearm itself, or at least without reference to a straightedge placed across the firearm. Thus, the technician does not require a distant horizontal or vertical object as a reference. This avoids the appearance of danger to others if the firearm is sighted from a window, and moreover permits the technician to align the scope accurately in a closed room without need for sunlight or lighted external objects. The tool may be formed of any practicable material, such as a relatively hard and durable plastic or even metal (aluminum, brass, etc.) so long as care is taken to avoid marring the scope when the tool is secured thereto.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

The telescopic sight alignment tool includes various embodiments, with each of the embodiments removably attaching to the ocular or eyepiece of the telescopic sight of a firearm. All of the embodiments function in essentially the same manner, i.e., by aligning an optical slit therein with the vertical crosshair of the scope reticle and then rotating the scope about its optical axis within its mounting rings to align one or more alignment indicators of the alignment tool with corresponding axes of the firearm or with a reference temporarily placed upon the firearm. Any of the various embodiments of the tool may be formed as a unitary, monolithic component of any practicable material, with plastic being a preferred material. However, various metals such as aluminum, brass, or even various steel or other metal alloys may be used, with care being taken to avoid marring the scope due to contact with such metals.

Figure 1:
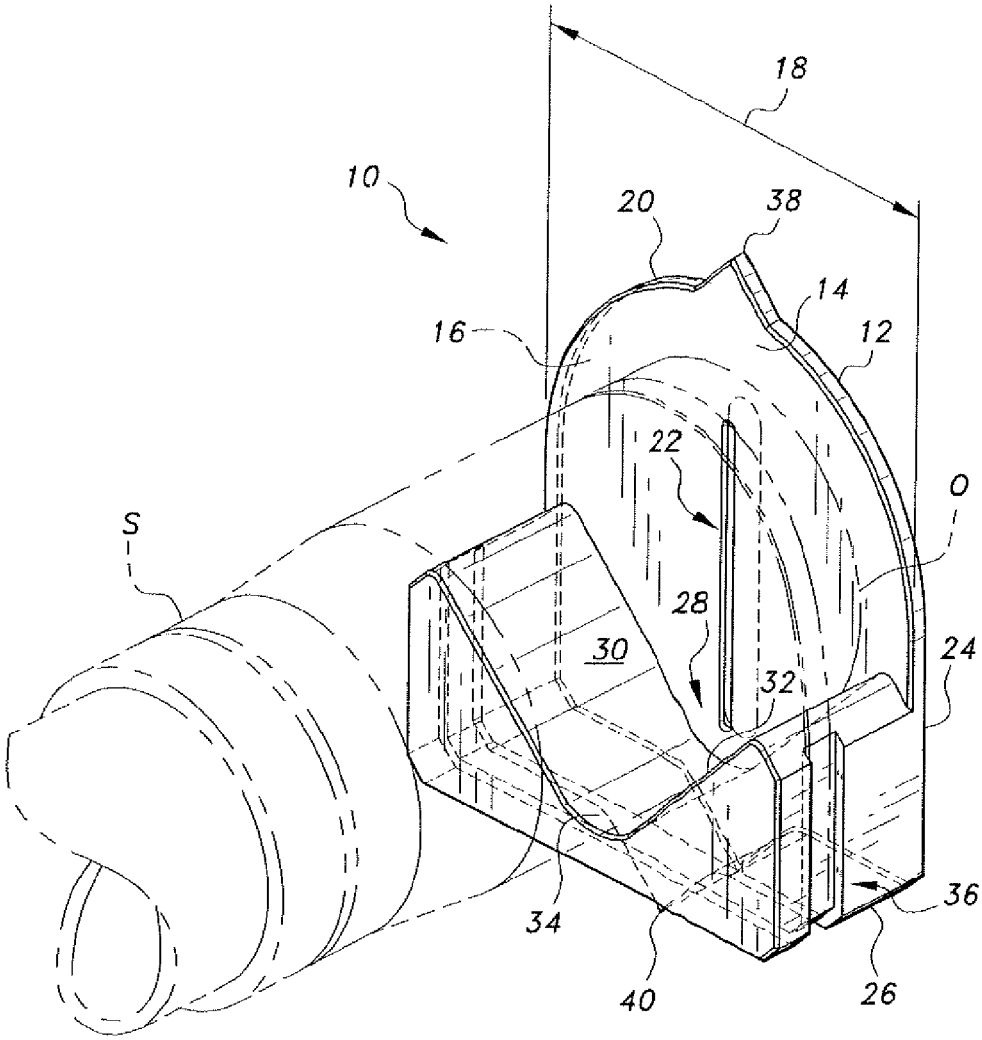
FIG. 1 is a perspective view of a first embodiment of a telescopic sight alignment tool according to the present invention, illustrating its features and details thereof.

FIG. 1 of the drawings provides a perspective view of a first embodiment 10 of the telescopic sight alignment tool, illustrating its various features. The tool 10 includes a thin, rigid, planar sighting plate 12 with a forward face 14 and an opposite rearward face 16, with the sighting plate 12 defining a lateral span 18. The upper edge 20 of the sighting plate 12 is preferably rounded to conform generally to the circular ocular or eyepiece of the telescopic sight with which it is intended to be used. A crosshair alignment slit 22 extends between the upper edge 20 and the opposite lower portion 24 of the sighting plate 12, with the alignment slit 22 adapted for alignment with the vertical crosshair of the scope reticle when the tool 10 is placed upon the ocular of the scope.

An ocular seating block 26 extends forwardly from the lower portion 24 of the sighting plate 12, with the seating block 26 having an ocular seat 28 formed therein. The seat 28 is preferably configured with mutually opposed downward and inward sloping surfaces 30 and 32 that meet at the bottom of the seat 28 to define a rounded apex 34. The seat 28 may have some other generally concave shape, but the provision of a V-shaped configuration as shown allows the seat 28 to fit about the lower portions of various scope oculars having various different diameters. A peripheral band retaining groove 36 extends around the opposite sides and at least a portion of the bottom of the ocular seating block 26. An elastic band (e.g., rubber band, elastic hair band, etc.) is seated in the groove 36, and passes over the top of the ocular to secure the tool 10 to the ocular of the scope. In this manner, the tool 10 may be rotated about the optical axis of the scope to align the crosshair alignment slit 22 with the vertical crosshair of the scope.

At least one alignment reference extends from the sighting plate 12. Preferably an upper alignment reference 38 extends from the center of the upper edge 20 of the sighting plate 12, with an opposite lower alignment reference 40 extending from the center of the lower portion 24 of the sighting plate 12. While only a single alignment reference is strictly required, preferably at least two such alignment references 38 and 40 are included to provide more options for the use of the tool 10. Each of the alignment references 38 and 40 comprises a protruding point in order to provide precise alignment for the tool 10, with the two alignment references 38 and 40 being aligned with the extended vertical axis of the crosshair alignment slit 22.

Figure 2:
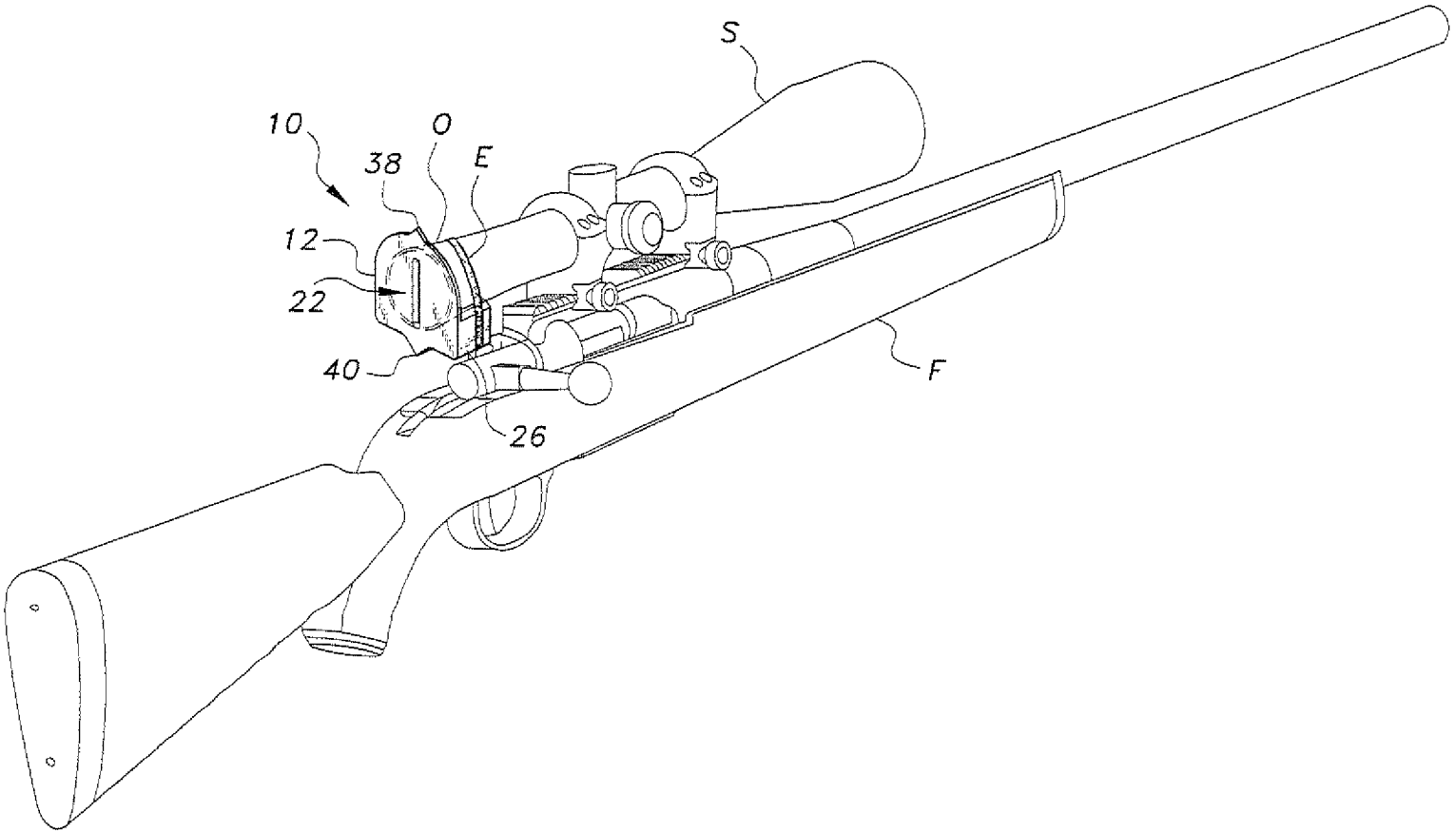
FIG. 2 is an environmental perspective view of a rifle equipped with a telescopic sight, showing the placement of the telescopic sight alignment tool according to the present invention upon the ocular of the scope for the adjustment and alignment thereof.
Figure 3:
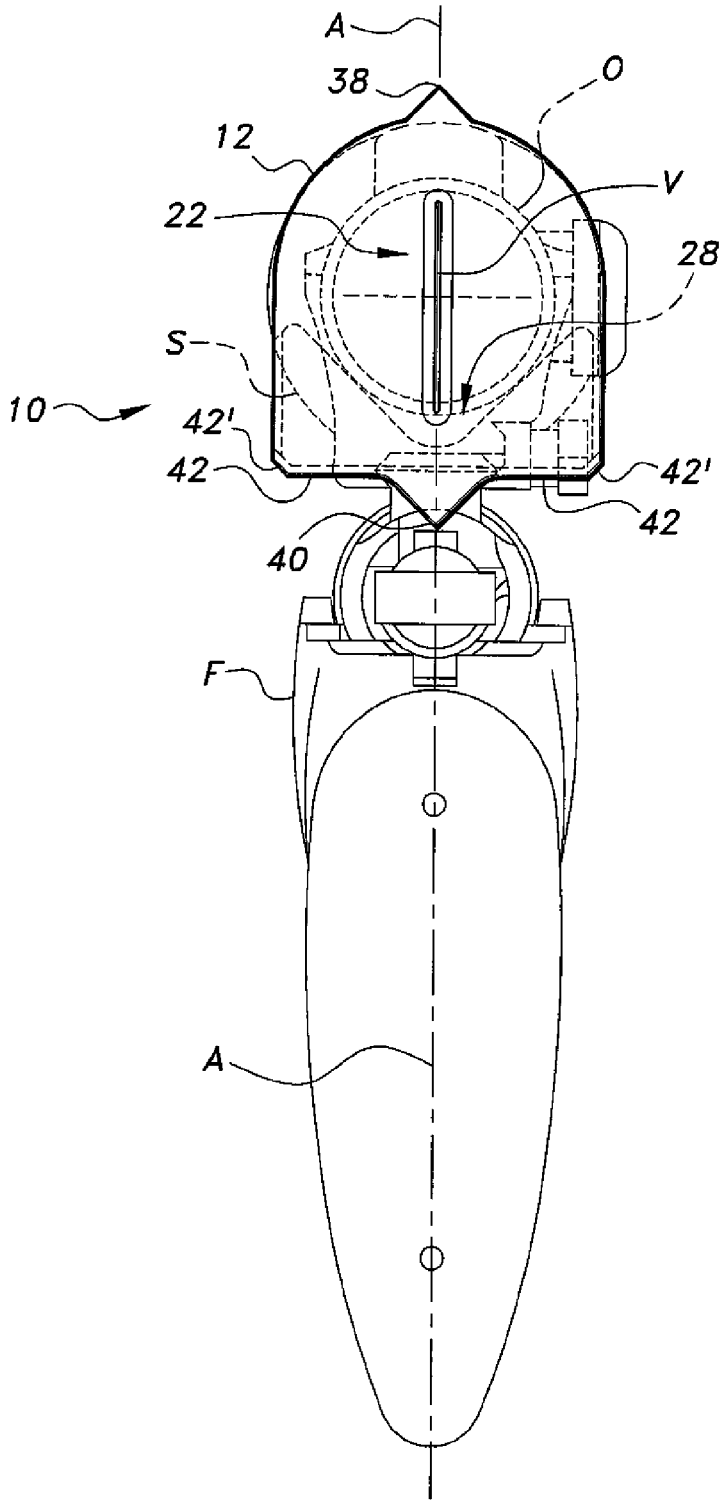
FIG. 3 is a rear elevation view of the rifle and telescopic sight of FIG. 2 with the telescopic sight alignment tool according to the present invention disposed upon the ocular of the scope, illustrating the proper sight picture when using the tool.
Figure 4:
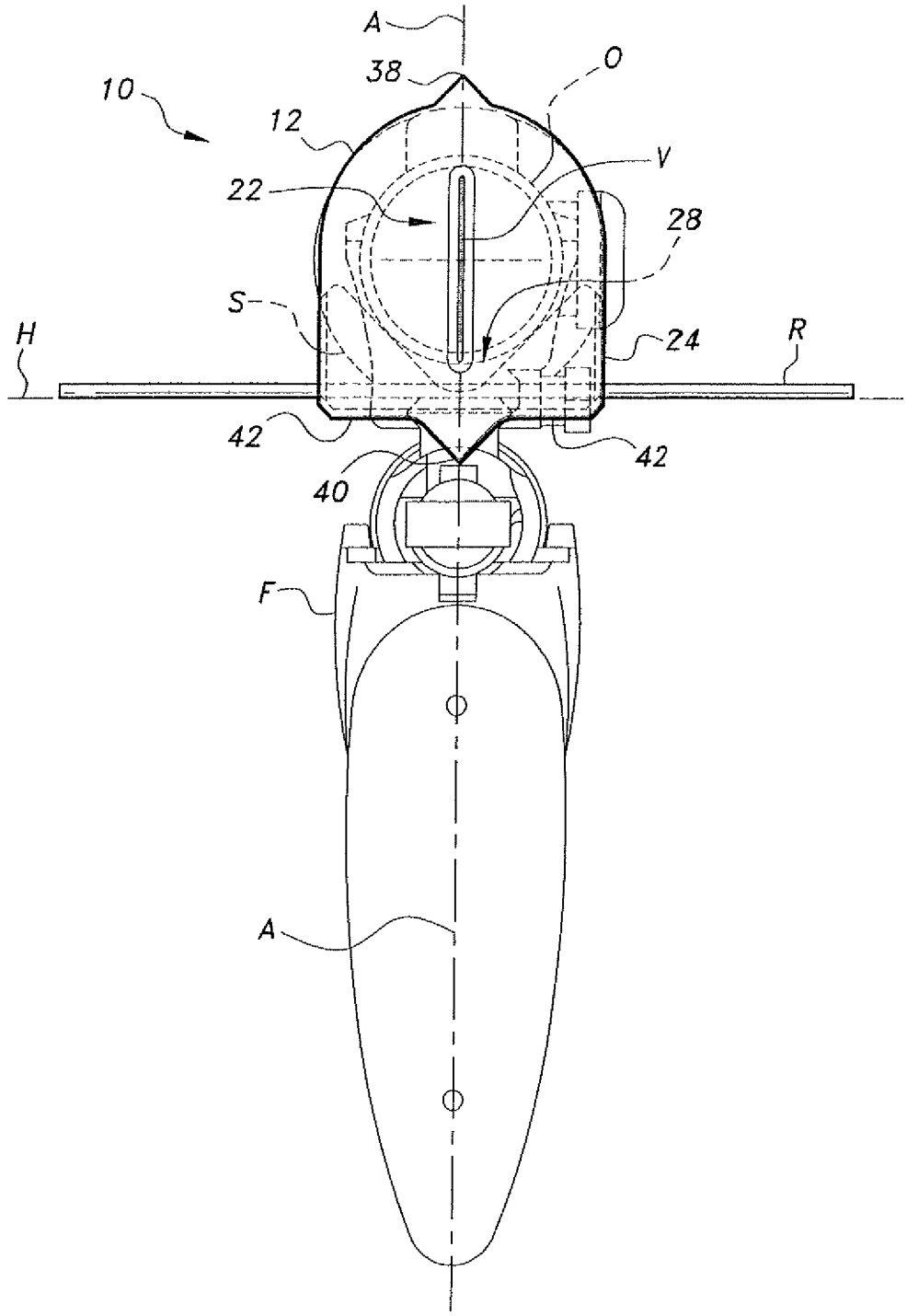
FIG. 4 is a rear elevation view of the rifle and telescopic sight of FIGS. 2 and 3 with the telescopic sight alignment tool according to the present invention disposed upon the ocular of the scope, illustrating an alternative method of using the tool.

FIGS. 2 through 4 provide environmental views showing the temporary installation of the telescopic sight alignment tool 10 upon the telescopic sight or scope S of a firearm F, with FIGS. 2 and 3 illustrating a first alignment method and FIG. 4 showing a second alignment method. It will be understood that the mounting rings for the scope S have been loosened slightly and the scope S is free to rotate about its optical axis within its mounting rings, in order to carry out the alignment process. In FIGS. 2 through 4, the tool 10 is shown secured to the eyepiece or ocular O of the scope S by means of an elastic band F (rubber band, etc.) secured in the retaining groove 36 (shown in FIG. 1) and extending around the upper portion of the ocular O. This provides secure attachment for the tool 10 to the ocular O, while still permitting the tool 10 to be rotated about the optical axis of the scope S. The tool 10 is rotated accordingly in order to align the crosshair alignment slit 22 with the vertical crosshair V of the scope reticle. It will be seen that this simultaneously aligns the tool 10 with the vertical axis of the scope S, since the vertical crosshair V in the scope reticle is aligned with the vertical axis of the scope. Thus, the upper alignment reference 38 will be aligned with any references along the upper portion of the scope S, e.g., the center of the upper turret or elevation adjustment knob, etc.

Once the crosshair alignment slit 22 has been aligned with the vertical crosshair V of the scope reticle and/or the upper alignment reference 38 has been aligned with some appropriate reference on the scope S as described above, either the upper or the lower alignment reference 38 or 40, or both references 38 and 40, are aligned with some reference on the firearm F by rotating the scope S in its mounting rings. The firearm reference may be a conventional front sight for the upper reference 38 if the sight is visible beyond the forward portion of the scope S, or perhaps the upper reference 38 may be centered on the forward end of the barrel. This is the purpose of the sight alignment tool 10, i.e., to align the scope about its optical axis so that the vertical axis of the scope S as represented by the vertical crosshair V and the vertical axis A of the firearm F are parallel to or coincident with one another. The lower reference 40 provides additional options in that it may be centered on the conventional tang of the mechanical action of the firearm F, or perhaps upon the groove conventionally formed in the tang (for bolt action firearms). These are reliable reference points, as their alignment is immovably affixed with the vertical axis of the firearm. Of course, the use of both the upper and lower reference points 38 and 40 provides even greater assurance of accuracy. When the vertical crosshair V of the scope S has been aligned with the vertical axis A of the firearm F, the scope mounting rings are tightened to lock the scope S immovably therein.

It should be noted that the telescopic sight alignment tool 10 relies solely upon features or points on the firearm and/or scope to carry out the alignment procedure. It is not necessary to sight the firearm on a distant object outside the room where the alignment is being carried out, or to travel to a firing range or other outdoor (or indoor) facility in order to carry out the scope alignment process using the tool 10. The scope alignment process may be accomplished in any small room using the telescopic sight alignment tool 10, so long as there is sufficient light to see the various reference and alignment points used.

FIG. 4 of the drawings illustrates an alternative alignment method using the telescopic sight alignment tool 10. It will be noted that the lower portion 24 of the sighting plate 12 of the tool 10 forms a flat lower edge, normal to the crosshair alignment slit 22. The flat bottom of the ocular seating block 26 is coplanar with the lower edge of the sighting plate 12, with the lower edge of the sighting plate 12 and the bottom of the seating block 26 being broken only by the lower alignment reference 40 and the elastic band retaining groove 36. This lower edge of the sighting plate 12 provides an alignment reference extension 42 extending laterally to each side of the lower alignment reference 40 but in the horizontal plane H of the firearm F rather than the vertical, i.e., normal to the crosshair alignment slit 22 of the sighting plate 12. This allows the scope alignment tool 10 to be used with a horizontal reference, e.g., a straight rod R (cleaning rod, etc.) placed atop a horizontal surface on the top of the firearm F such as the conventional Picatinny rail used for mounting the telescopic sight S, or other laterally horizontal reference. The ends of the horizontal alignment reference extension 42 (as illustrated in FIG. 3) may be beveled as shown at 42', to provide the user with additional alignment options and accuracy by means of the corners of the bevels and alignment of the rod R with the facets and/or corners of the bevels.

It will be noted that the precise alignment of the rod R with any of the various features of the alignment tool 10 will depend upon any parallax between the eye of the person performing the alignment, the references on the tool 10, and the position of the horizontal rod R. For example, in FIG. 4 the lower edge of the rod R is shown slightly above the upper corners of the beveled corners at each lower corner of the tool 10. However, slightly lowering the eye of the person performing the alignment will have the effect of raising the lower edge of the alignment tool 10 to align some appropriate indicators on the tool 10 (e.g., the outer corners of the bevels at each lower corner, or other indicators as appropriate) with the lower edge, or perhaps the upper edge, of the rod R forward of the tool 10. The specific references used are not critical, so long as corresponding references are used at each side of the tool 10.

Figure 5:
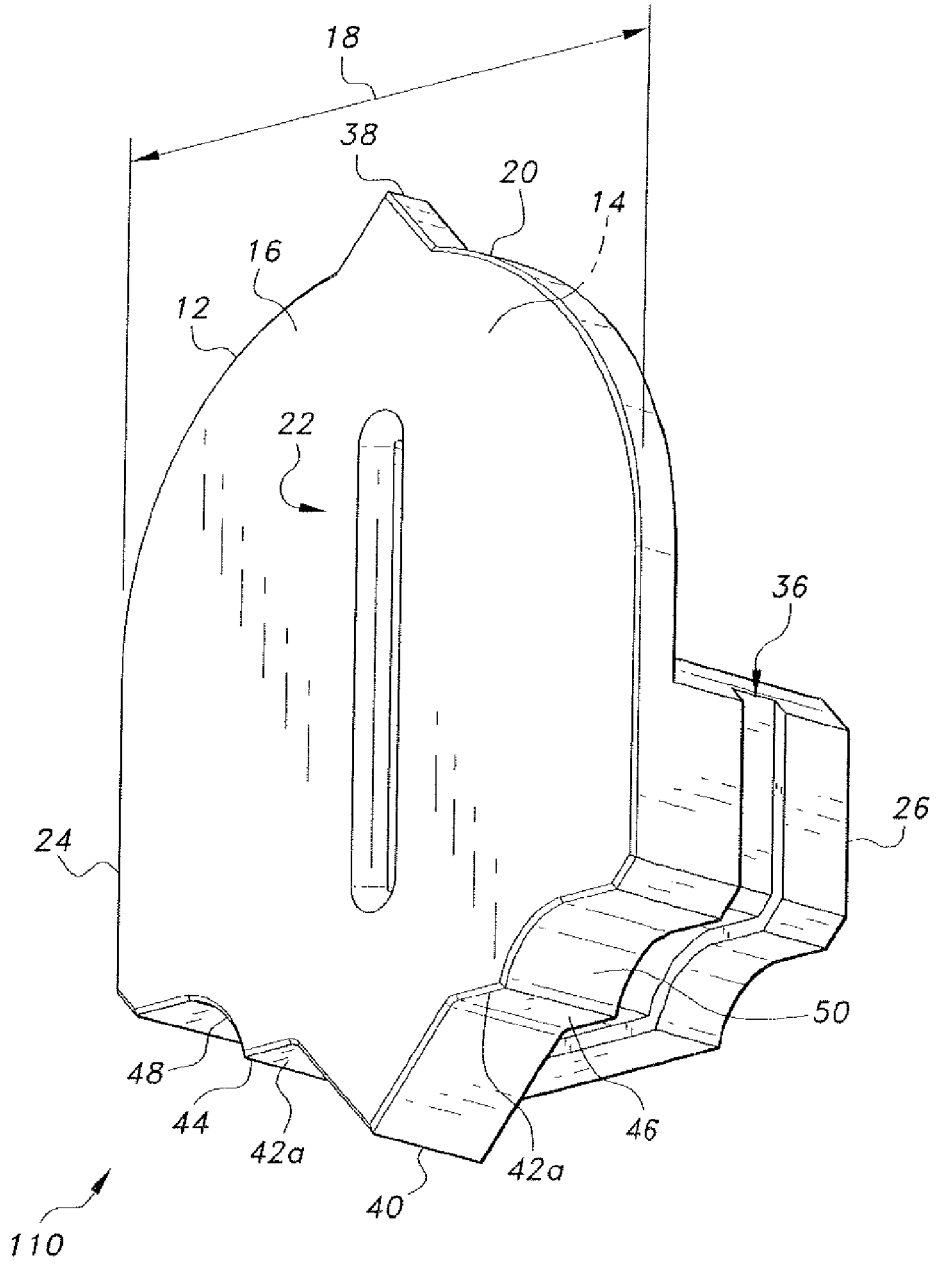
FIG. 5 is a rear perspective view of an alternative embodiment of the telescopic sight alignment tool according to the present invention, illustrating various features and details thereof.
Figure 6:
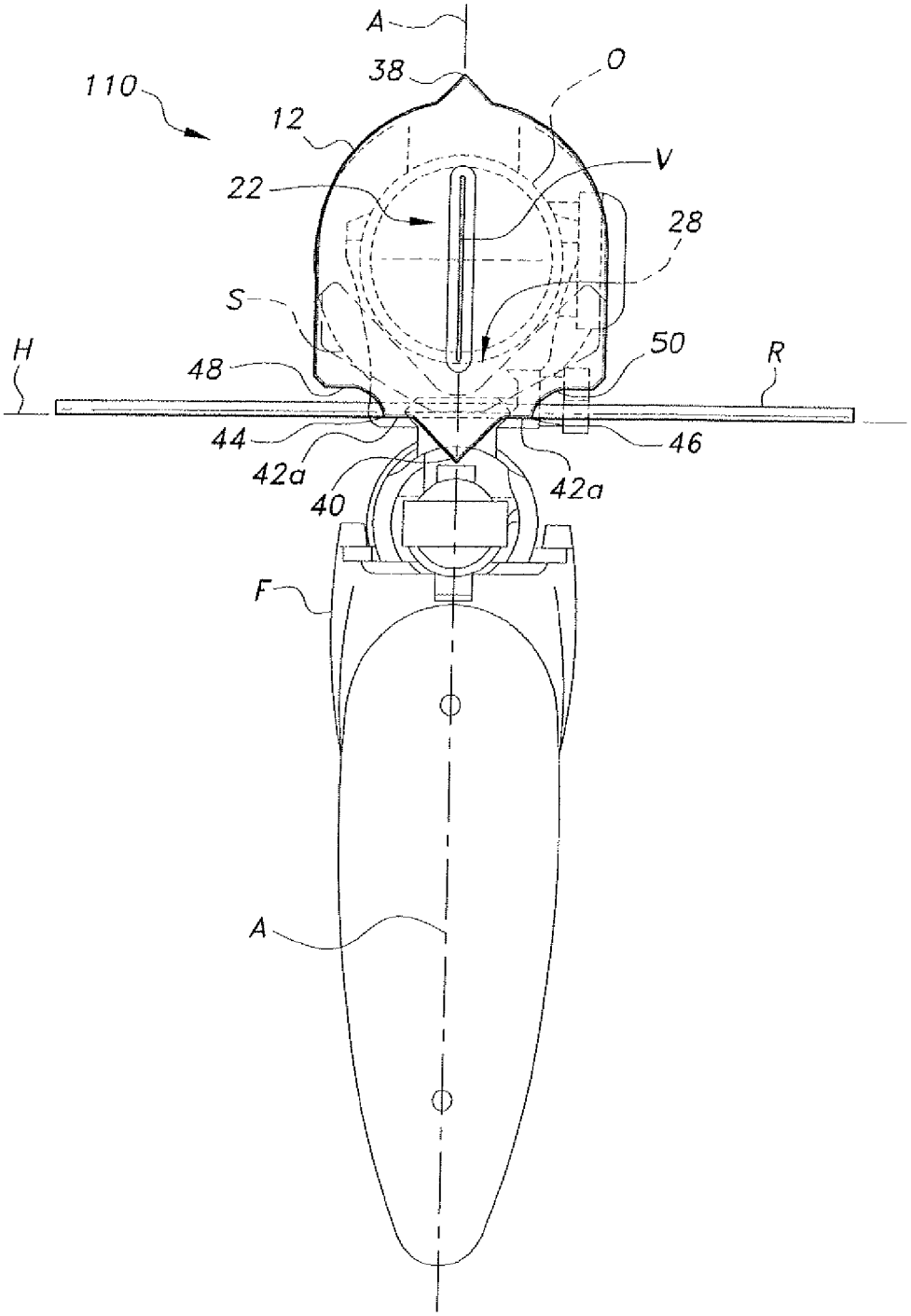
FIG. 6 is a rear elevation view of the rifle and telescopic sight of FIGS. 2, 3, and 5 with the telescopic sight alignment tool embodiment of FIG. 5 disposed upon the ocular of the scope, illustrating a method of using the tool similar to that shown in FIG. 4.

FIGS. 5 and 6 of the drawings provide illustrations of a second embodiment 110 of the telescopic sight alignment tool. The tool 110 includes most of the features of the tool 10 of FIGS. 1 through 4, but it will be seen that the opposite first and second ends 44 and 46 of the extension 42*a* define corresponding first and second concave scallops or reliefs 48 and 50 between the outboard ends of the extension 42*a* and the lateral span 18 of the sight alignment tool 110. It will be seen in FIG. 5 that this structure continues forwardly to the forward end of the ocular seating block 26.

FIG. 6 provides an environmental perspective view of the telescopic sight alignment tool 110 installed upon the ocular O of a telescopic sight S that is in turn mounted upon a firearm F. In the example of FIG. 6, a straight length of rod R is placed across some laterally horizontal reference on the firearm F, e.g., an accessory mounting rail, etc., that is parallel to a laterally horizontal reference H of the firearm, similar to the example of FIG. 4. The alignment tool 110 with its lower corner reliefs 48 and 50 may be of some benefit when using the tool 110 with a telescopic sight having a larger diameter ocular. In such a case, the tool 10 or 110 is displaced downward when attached to the scope S due to the larger diameter of the ocular. This may position the lower references of the tool, e.g., the beveled corners, etc., uncomfortably low for the person performing the alignment. The lower corner reliefs 48 and 50 of the tool 110 provide somewhat higher lateral references by means of the junctures of the raised outer ends of the reliefs with the vertical sides of the tool 110. It will be noted in FIG. 6 that the horizontal rod R is not precisely aligned with any of the corners or other lateral references of the tool 110. As in the discussion provided further above in the use of the tool 10 shown in FIG. 4, some slight vertical adjustment of the eye of the person performing the scope alignment to adjust for parallax is all that is necessary to align the upper or lower edge of the rod R with appropriate horizontal references of the tool 110.

Figure 7:
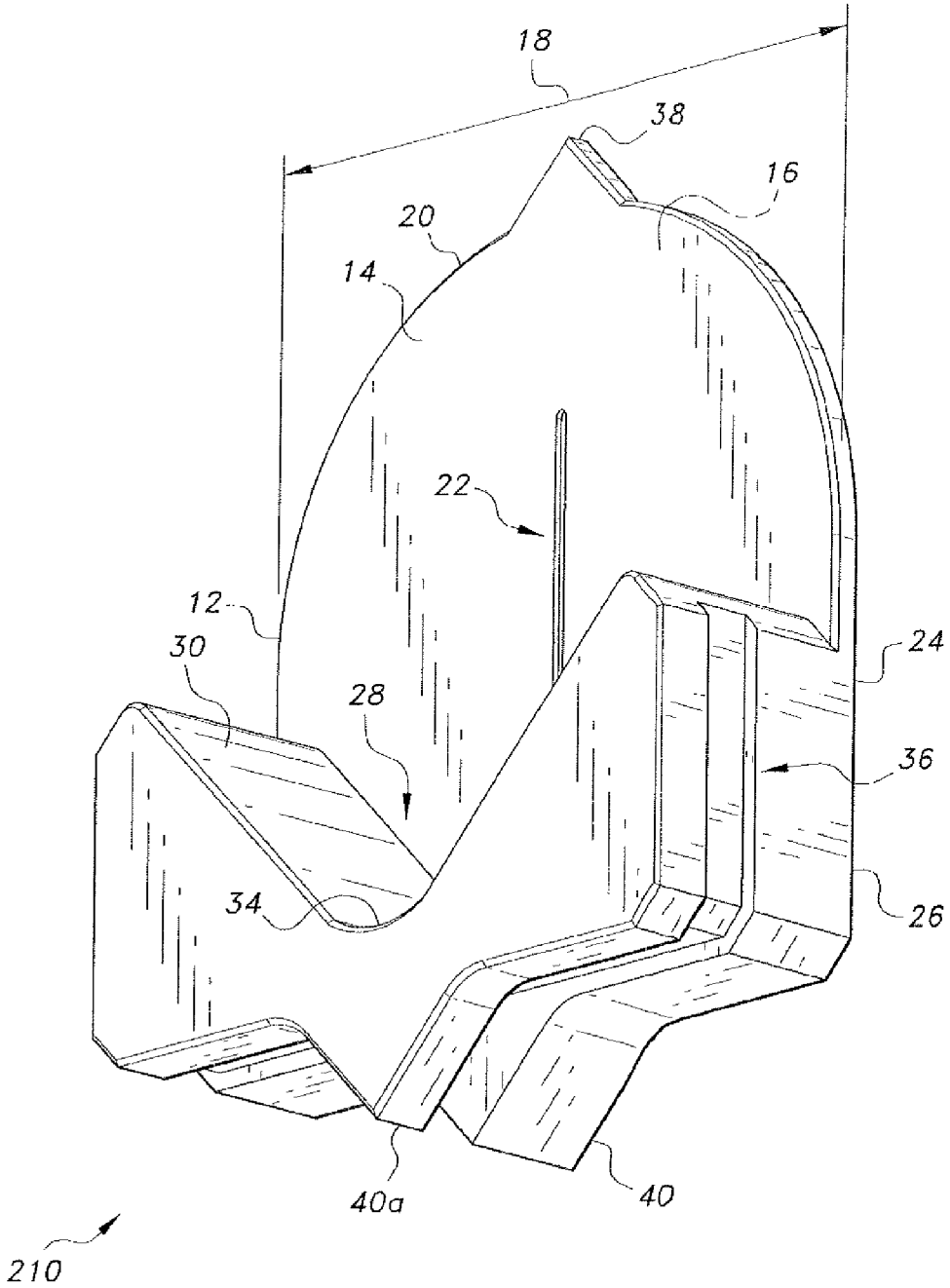
FIG. 7 is a front perspective view of another alternative embodiment of the telescopic sight alignment tool according to the present invention, illustrating various features and details thereof.
Figure 8:
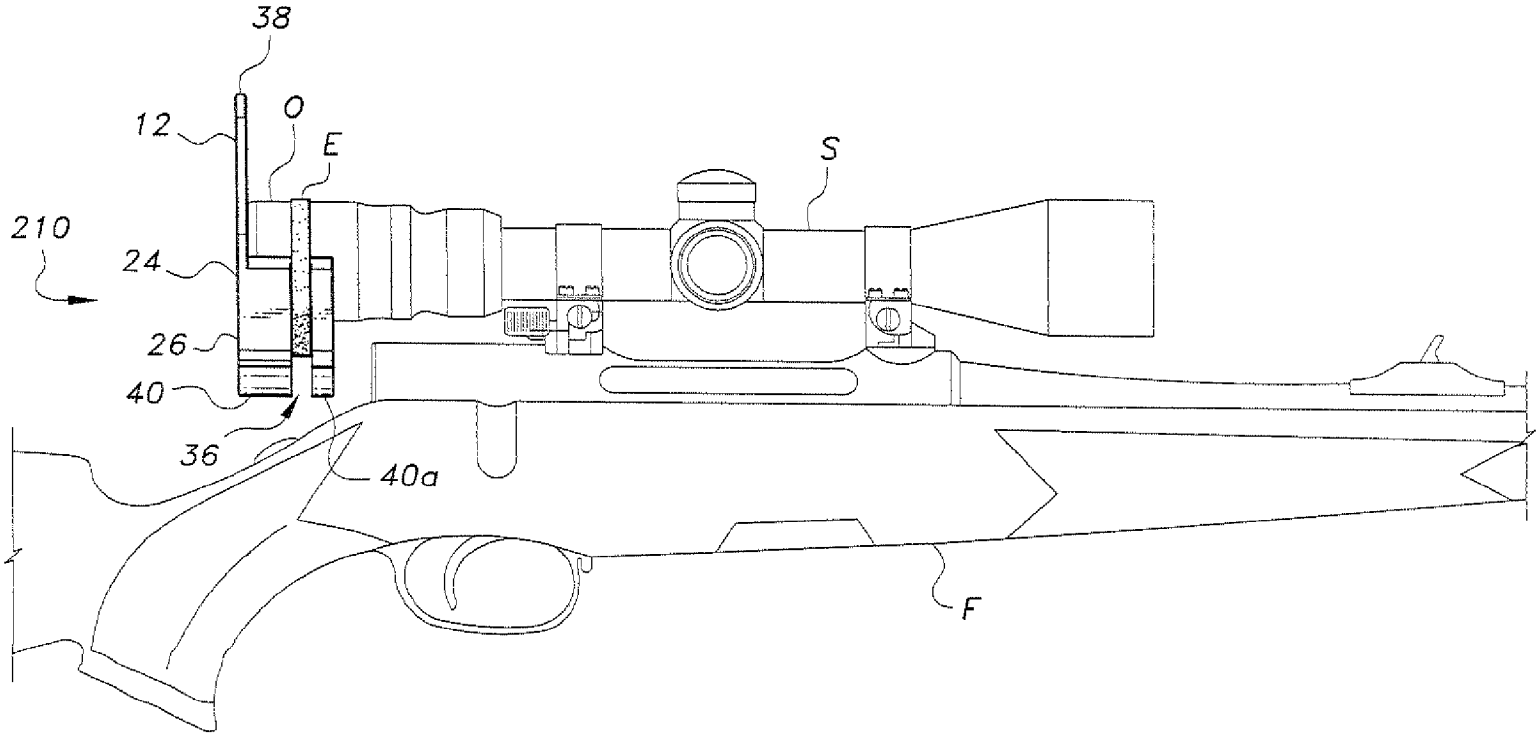
FIG. 8 is a right side elevation view of a rifle equipped with a telescopic sight with the bolt removed from the rifle in order to provide for the use of the tool embodiment of FIG. 7, showing the tool of FIG. 7 installed upon the ocular of the scope.

FIG. 7 provides a perspective view of another alternative telescopic sight alignment tool 210, with FIG. 8 illustrating its temporary installation upon the scope of a firearm F. The sight alignment tool 210 is essentially identical to the tool 10 of FIGS. 1 through 4, with the exception of a forward extension 40*a* of the lower alignment reference 40. It will be noted that in the embodiments 10 and 110 of FIGS. 1 through 6, that there is no forwardly disposed portion or extension of the lower alignment reference 40. The lack of a forward portion of the lower alignment reference provides clearance for the structure of the firearm F, particularly for a bolt action rifle or the like when the bolt remains installed. However, it is a relatively simple matter to remove the bolt from such a rifle, if so desired. The telescopic sight alignment tool 210 of FIGS. 7 and 8 may be used to align the scope S installed on such a bolt action rifle, once the bolt has been removed to provide clearance for the forward extension 40*a* of the lower alignment reference 40, as shown in FIG. 8.

Any of the various telescopic sight alignment tools 10, 110, and 210 may be used to align a firearm scope about its optical axis in order that the vertical crosshair of the scope reticle is truly parallel to the vertical axis of the firearm. While three different embodiments are disclosed herein, it will be seen that a fourth embodiment comprising the tool 110 of FIGS. 5 and 6 and incorporating the forward extension 40*a* of the lower alignment reference provided with each of the tools 10 through 210 may also be provided. Each of the tools 10, 110, and 210 may be used with a scope equipped firearm in an indoor environment, and in fact the indoor environment need not even have a window(s) or other visual access to the outdoors, so long as there is sufficient light in the room to enable the technician to see the various alignment marks, indicators, and guides clearly. No other equipment is required, with the exception of a screwdriver or the like for loosening and tightening the scope ring mounts and an elastic band to secure the tool temporarily to the ocular of the scope.

It is to be understood that the present invention is not limited to the embodiments described above, but encompasses any and all embodiments within the scope of the following claims.

I claim:

1. A telescopic sight alignment tool, comprising:

a planar sighting plate having a forward face, a rear face opposite the forward face, a lateral span, an upper edge, a lower portion opposite the upper edge, and a crosshair alignment slit extending between the upper edge and the lower portion thereby defining a vertical alignment plane;

an ocular seating block extending forwardly from the lower portion of the sighting plate, the seating block having an ocular seat formed therein, the ocular seat being defined by mutually opposed first and second sloping surfaces defining a V configuration, the seat subtending only a portion of the ocular of the telescopic sight when seated thereon;

at least one alignment reference extending from the sighting plate, the at least one alignment reference includes an extension disposed laterally and horizontally along the lower portion of the sighting plate, the alignment reference extension thereby defining an alignment edge laterally disposed to the vertical alignment plane of the alignment slit of the sighting plate; and the sighting plate, the ocular seating block, and the alignment reference collectively being formed of a single, unitary piece of material.

2. The telescopic sight alignment tool according to claim 1 further comprising the seating block having a peripheral band retaining groove disposed at least partially therearound.

3. The telescopic sight alignment tool according to claim 1, further comprising the alignment reference extension having mutually opposed first and second ends, the first and second ends of the alignment reference extension defining corresponding first and second reliefs between the first and second ends thereof and the lateral span of the sighting plate.

4. The telescopic sight alignment tool according to claim 1, further comprising: an upper alignment reference indicator extending from the upper edge of the sighting plate.

5. The telescopic sight alignment tool according to claim 1, wherein the sloping surfaces define a rounded apex therebetween.

6. The telescopic sight alignment tool according to claim 1 further comprising the single, unitary piece of material being formed of materials selected from the group consisting of plastic and metal.

7. The telescopic sight alignment tool according to claim 1, wherein the lateral ends of the alignment reference extension include bevels.

8. The telescopic sight alignment tool according to claim 3, wherein the reliefs are configured as concave scallops.

* * * * *